US011305286B2

(12) United States Patent
Ebetsberger et al.

(10) Patent No.: US 11,305,286 B2
(45) Date of Patent: Apr. 19, 2022

(54) COLLECTION ASSEMBLY OR TEST TUBE FOR A SMALL AMOUNT OF A BODY FLUID, COMPRISING AN EXTENDER ELEMENT

(71) Applicant: Greiner Bio-One GmbH, Kremsmuenster (AT)

(72) Inventors: Franz Ebetsberger, Kremsmuenster (AT); Arnold Boeck, Asten (AT)

(73) Assignee: Greiner Bio-One GmbH, Kremsmuenster (AT)

( * ) Notice: Subject to any disclaimer, the term of this patent is extended or adjusted under 35 U.S.C. 154(b) by 238 days.

(21) Appl. No.: 16/610,143

(22) PCT Filed: Apr. 25, 2018

(86) PCT No.: PCT/AT2018/060079
§ 371 (c)(1),
(2) Date: Nov. 1, 2019

(87) PCT Pub. No.: WO2018/201174
PCT Pub. Date: Nov. 8, 2018

(65) Prior Publication Data

US 2020/0070147 A1 Mar. 5, 2020

(30) Foreign Application Priority Data

May 2, 2017 (AT) ..... A 50352/2017

(51) Int. Cl.
*B01L 3/00* (2006.01)

(52) U.S. Cl.
CPC ..... *B01L 3/5082* (2013.01); *B01L 2200/02* (2013.01); *B01L 2300/04* (2013.01);
(Continued)

(58) Field of Classification Search
CPC ..... B01L 3/5082; B01L 2200/02; B01L 2300/04; B01L 2300/0851;
(Continued)

(56) References Cited

U.S. PATENT DOCUMENTS 4,210,418 A 7/1980 Brown et al.
5,294,011 A 3/1994 Konrad et al.
(Continued)

FOREIGN PATENT DOCUMENTS

AU 626849 B2 8/1992
CN 1490623 A 4/2004
(Continued)

OTHER PUBLICATIONS

International Search Report in PCT/AT2018/060079, dated Jul. 25, 2018.
(Continued)

*Primary Examiner* — Benjamin R Whatley
*Assistant Examiner* — Jacqueline Brazin
(74) *Attorney, Agent, or Firm* — Collard & Roe, P.C.

(57) ABSTRACT

The invention relates to a collection assembly (1) for small amounts of body fluids, comprising a sample container (2) and an extender element (3). The sample container (2) has a base (13) and a container wall (5) with a first container wall section (6) and a second container wall section (7) adjoining same. The second container wall section (7) is formed hollow-conically and projects into the extender element (3). Moreover, a coupling device (25) with a first coupling element (26) and a second coupling element (27) is provided. When the coupling elements (26, 27) are in coupled engagement, the extender element (3) is coupled to the sample container (2) in a positively locked manner in the form of a snap connection establishing the collection assembly (1).

7 Claims, 3 Drawing Sheets

Figure 1:
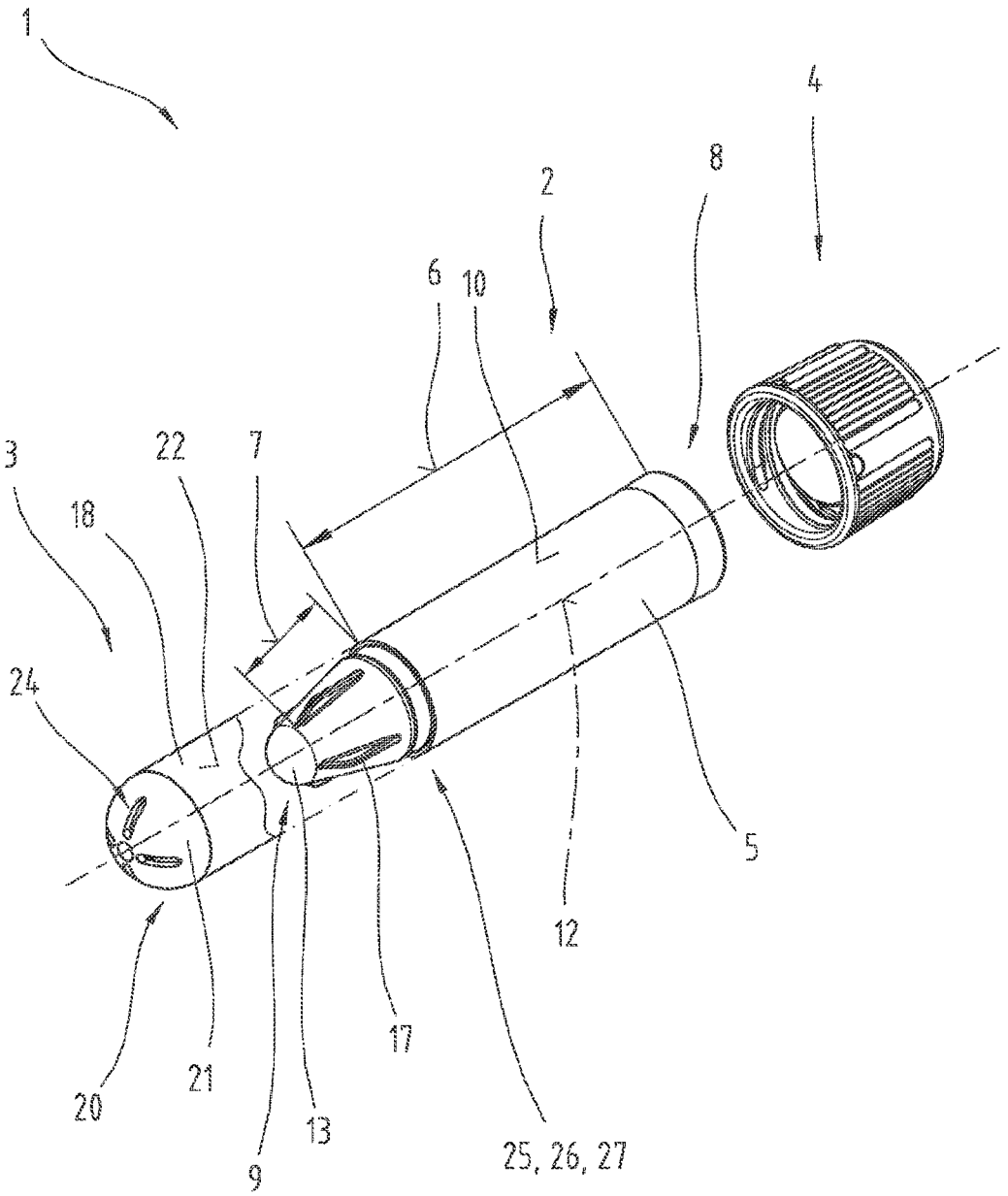

(52) U.S. Cl.
CPC ..... *B01L 2300/0851* (2013.01); *B01L 2300/0854* (2013.01); *B01L 2300/0858* (2013.01)

(58) Field of Classification Search
CPC ..... B01L 2300/0854; B01L 2300/0858; B01L 3/5021; B01L 2200/023
USPC ..... 422/550
See application file for complete search history.

(56) References Cited

U.S. PATENT DOCUMENTS

| | | | | |
|---|---|---|---|---|
| 5,344,036 | A | 9/1994 | Stanescu et al. | |
| 5,470,537 | A * | 11/1995 | Siegel | B65D 23/001 422/562 |
| 5,942,191 | A | 8/1999 | Conway | |
| 5,948,365 | A | 9/1999 | Macy et al. | |
| 6,270,728 | B1 | 8/2001 | Wijnschenk et al. | |
| D447,812 | S | 9/2001 | Conway | |
| 8,448,800 | B2 | 5/2013 | Konrad | |
| 10,004,444 | B2 | 6/2018 | Bauer et al. | |
| 2002/0156439 | A1 | 10/2002 | Iskra | |
| 2003/0213312 | A1 | 11/2003 | DeYoung et al. | |
| 2004/0013574 | A1 | 1/2004 | Conway | |
| 2011/0308335 | A1 | 12/2011 | Pink et al. | |
| 2012/0141341 | A1 | 6/2012 | Bartfeld et al. | |
| 2018/0008978 | A1* | 1/2018 | Balhara | B01L 3/5021 |
| 2018/0141044 | A1 | 5/2018 | Ebetsberger et al. | |

FOREIGN PATENT DOCUMENTS

| | | | |
|---|---|---|---|
| CN | 103237602 | A | 8/2013 |
| EP | 0 445 707 | B1 | 9/1991 |
| EP | 0 419 490 | B1 | 11/1993 |
| EP | 0 901 818 | A2 | 3/1999 |
| EP | 1 382 394 | A1 | 1/2004 |
| EP | 0 891 742 | B1 | 4/2004 |
| EP | 1 711 412 | B1 | 11/2010 |
| FR | 2 893 312 | A1 | 5/2007 |
| JP | H11-151217 | A | 6/1999 |
| JP | H11-151227 | A | 6/1999 |
| JP | 2004-093559 | A | 3/2004 |
| JP | 2005-534893 | A | 11/2005 |
| JP | 2012-500983 | A | 1/2012 |
| WO | 2012/074738 | A1 | 6/2012 |
| WO | 2014/151996 | A2 | 9/2014 |
| WO | 2015/051389 | A1 | 4/2015 |
| WO | 2016/176703 | A1 | 11/2016 |

OTHER PUBLICATIONS

Chinese Office Action in Chinese Application No. 201880029085.2, dated Feb. 3, 2021 with English translation.

* cited by examiner

COLLECTION ASSEMBLY OR TEST TUBE FOR A SMALL AMOUNT OF A BODY FLUID, COMPRISING AN EXTENDER ELEMENT

CROSS REFERENCE TO RELATED APPLICATIONS

This application is the National Stage of PCT/AT2018/060079 filed on Apr. 25, 2018, which claims priority under 35 U.S.C. § 119 of Austrian Application No. A50352/2017 filed on May 2, 2017, the disclosure of which is incorporated by reference. The international application under PCT article 21(2) was not published in English.

The invention relates to a collection assembly for collecting a small amount of a body fluid, in particular a blood sample.

Such tubular sample containers with common standard dimensions of length and diameter usually have a so-called "false bottom" and are also referred to as "false bottom tubes".

In further collection assemblies, the smaller sample collection container was inserted into a separate support tube so as to allow for formation of the common standard dimensions of length and diameter together with it.

There are also designs in which an additional further sample container is arranged on a sample container with a smaller axial extension for the purpose of elongation.

A generically formed collection assembly for collecting a small amount of a sample became known from EP 1 382 394 A1. The collection assembly comprises a first upper tube and a second lower tube as well as a closure. The two tubes are dimensionally almost identical to one another, but are made from different materials. Each of the tubes comprises a first tube section and a second tube section adjoining thereon, which are formed hollow-cylindrically and are connected to form one unit by means of a connecting section. In the end portion of each tube opposite to the open end, the second hollow-cylindrical tube section is provided which is inserted into the open end and thus into the first tube section of the other tube to form the collection assembly. A coupling device with cooperating coupling elements may be provided in the overlapping section of the joined tubes for mutual support and fixing of the joined tubes.

U.S. Pat. No. 5,344,036 A1 describes a container system for sample collection for medical applications. The collection container is formed to be vial-shaped with a constricted neck section that can be closed with a closure. The receiving container comprises a first container wall section and a second container wall section connected thereto by means of a transition section. The closing base wall section is arranged in a plane extending in normal alignment with respect to a longitudinal axis and is planar. The second container wall section is conically tapered, with a coupling device for coupling a hat-shaped auxiliary part being provided in the transition section between the first container wall section and the second container wall section. An opening of opposite shape for receiving the conically tapering second container wall section is arranged in the end wall of the auxiliary part.

U.S. Pat. No. 5,470,537 A1 describes a base element for holding and handling a vial with a conical bottom. Conical bottoms are generally used for ampules, which are relatively small and commonly referred to as ampules or vials with a limited volume. They are not large enough to have, in addition to the neck, a base large enough to provide support in an upright position and also to create a space for finger grip. The conical bottoms of such small vials are arranged in trays for the purpose of storage, these trays usually having several conical receptacles that hold the vials in an upright position. In order to be able to place each individual ampoule or vial on its own and to be able to handle it more easily, a base part is provided in which the bottom end region of the ampoule or vial can be inserted into a specially designed receiving recess. The receiving recess forms an undercut at its inlet opening facing the ampoule or the vial, said undercut forming a coupling device for the ampoule or the vial.

FR 2 893 312 A1 also describes a base part that can be placed on a bottom end of a sample tube. The base part can be slid onto the sample tube in two different use positions. On one side opposite to a flat support surface, the base part has two supporting arms opening in a V-shape, which come into contact on the outside of the cylindrical container wall. In a further possible use position, the sample tube perforates the base part in a position offset by 90° with respect to the first position, the support surface then having a parallel orientation with respect to the longitudinal axis of the sample tube.

A labeling device for sample tubes became known from US 2011/0308335 A1. A carrier part can be snapped onto the bottom side conically tapering end section of the sample tube by means of a coupling device. In this regard, the carrier part can have an approximately cylindrical outer shape or a conically tapering outer shape.

Such a collection assembly also became known from U.S. Pat. No. 5,942,191 A as well as EP 0 891 742 B1 based thereon. It comprises a first elongated tube forming an axis. The first tube comprises an open end with an inner diameter "X" and a closed end section with an outer diameter "Y". The outer diameter "Y" of the closed end section is smaller than the inner diameter "X" of the open end. In the first tube, a receiving chamber, which is accessible from the open end, for receiving a fluid sample is provided. A second elongated tube is provided, which is essentially identical to the first tube. The closed end section of the first tube is designed such that it is conjugately disposed in the open end of the second tube so that the first tube and the second tube are substantially axially aligned and thereby form a single article. The two equally designed tubes are held together by means of a friction-based retaining connection. Due to the equal design of both tubes, an additional molding tool could be dispensed with; however, no secure and sufficient mutual connection of the two tubes to one another could be achieved.

Another solution for reducing the receiving space and for elongation to a standard dimension is described in WO 2016/176703 A1. On the sample container for sample collection, two container extension pieces are formed in its bottom-side closed end section and are each pivotably connected thereto by means of a hinge arrangement. Hence, the entire collection assembly also with the closed base can be formed in one single manufacturing operation. For the formation of the standard dimension regarding the container length, the two container extension pieces must merely be folded together in the direction towards the longitudinal axis and be held fixed to one another. Hence, the collection assembly can be formed in one single manufacturing operation; however, it is advantageous in this regard that the injection molding tool is complex and expensive to manufacture as well as in the manufacturing operation. Moreover, the connection and design of the connection pieces in the base area of the sample container entails material accumulations, which also means unnecessary material consumption and leads to unequal cooling speeds.

It was the object of the present invention to overcome the shortcomings of the prior art and to provide a collection assembly in which an ideal component geometry for the manufacturing operation is allowed for each component and, additionally, a dimensionally stable and distortion-free formation with a secure mutual purchase on one another is possible.

This object is achieved by means of a collection assembly according to the claims.

The collection assembly according to the invention is provided for collecting a small amount of a body fluid, in particular a blood sample, urine, *salvia*, and can comprise at least the following components:

a sample container with a container wall, said container wall extending from a first open end to a second end, being limited by an outer surface and an inner surface and defining a longitudinal axis, and with a base, said base closing the second end of the container wall and surrounding a collecting chamber together with the container wall, and wherein the container wall comprises a first container wall section and a second container wall section adjacent thereto in the direction of the longitudinal axis, wherein the first container wall section is formed hollow-cylindrically with a first outer diametric dimension and is arranged starting out from the open end, and wherein the second container wall section comprises an at least sectionally smaller second diametric dimension with respect to the first outer diametric dimension of the first container wall section, and wherein a transition section is arranged between the first container wall section and the second container wall section, an extender element having a side wall, said side wall extending from a first open end to a second end, and having a base wall arranged to be adjacent to the second end, wherein the base wall of the extender element is calotte-shaped, in particular hollow-spherical-calotte shaped, and wherein the sample container at least partially projects into the first open end of the extender element with its second container wall section arranged at a distance from the first open end in the direction of the longitudinal axis, wherein a coupling device with at least one first coupling element and with at least one second coupling element, wherein the at least one first coupling element is arranged or formed on the sample container and the at least one second coupling element is arranged or formed on the extender element, and wherein when the first and second coupling elements are in coupled engagement, the extender element is coupled to the sample container in a positively locked manner by means of a snap connection formed by the coupling elements establishing the collection assembly, and therein the second container wall section of the container wall is formed hollow-conically, the at least one first coupling element is arranged in a transition section between the first container wall section and the second container wall section of the container wall, the side wall of the extender element between the first open end and the second end is formed hollow-cylindrically and the side wall is formed to be continuous and straight as seen in axial section between the first open end and the second end, the at least one first coupling element is formed as a continuous peripheral first groove as well as the wall section of the side wall of the sample container adjoining thereon in the direction towards the base of the sample container, a first side face of the first recess or of the first groove, said first side face facing the open end of the sample container, forms an abutment surface for an end face of the extender element in the region of its first open end and the first side face forms an axial abutment for the first end face of the extender element, several support elements arranged distributed across the circumference are provided, said support elements being arranged on the outer surface of the second container wall section of the container wall and projecting beyond the outer surface towards the side facing away from the longitudinal axis, the support elements are formed as webs, said webs having a particularly parallel longitudinal extent with respect to the longitudinal axis, and further an outer envelope of the webs forming the support elements has a diameter, said diameter being equal to or slightly larger than an inner diameter of the side wall of the extender element in the region of its open end, in the base wall of the extender element at least one breakthrough, preferably several breakthroughs, is or are arranged, said breakthrough or said breakthroughs perforating the base wall, and the at least one breakthrough is arranged at a distance from the longitudinal axis in the radial direction and the base wall is formed continuously in the region of the longitudinal axis.

The advantage that is thereby achieved consists in that by providing a separate coupling device, a mutual, positively locked connection and mounting of the extender element on the sample container can be created. By means of the additional hollow-conical design of the second container wall section, hence, the formation and arrangement of the individual coupling elements can be designed to be favorable in terms of technical form. Moreover, by selecting the hollow-conically shaped second container wall section, a central injection point in the region of the base of the sample container can be allowed for. However, by selecting the coupling elements cooperating in a positively locking manner, hence, a material accumulation on the sample container as well as the extender element also can be prevented, whereby more consistent cooling times can be achieved. In addition to this, hence, distortion, the occurrence of internal stresses, air inclusions or blowholes can also be avoided. Thus, both the sample container and the extender element can each be produced in an individual cavity and can each individually be designed with the ideal component geometry. The respective cavities can either be arranged in respective individual injection molds or be arranged in a common injection mold. The use of a rotating cube tool would also be possible. Additionally, after the simultaneous production of sample containers and extender elements, the collection assembly could immediately be assembled in particular in an automated manner. By means of the coupling device, the sample container and the extender element can then be coupled to one another establishing an assembly unit, which securely prevents unintended releasing from one another by means of the mutual positively locked connection.

If the base wall of the extender element is calotte-shaped, in particular hollow-spherical-calotte shaped, hence, a base geometry adapted to a common centrifuge device is created in the base region.

Moreover, the at least one first coupling element is arranged in a transition section between the first container wall section and the second container wall section of the container wall. This creates the possibility of forming the sample container and the extender element with approximately equal outer dimensions as compared to one another, so as to hence allow for the formation of a continuous, even, in particular straightly formed outer surface in the coupled state of the sample container with the extender element.

Furthermore, if the side wall of the extender element is formed to be hollow-cylindrically, in particular continuously and straightly, between the first open end and the second end, an extender element that can be manufactured easily and cost-effectively is hence created by the continuous and straight formation of the side wall. Moreover, hence, the attachment of at least one label on the outer surface of the sample container and the extender element is also facilitated and improved. In particular where, as seen in axial section, a straight transition between the outer surfaces of the sample container and the extender element is formed.

It is further provided for that the at least one first coupling element is formed as a continuous peripheral first groove as well as the wall section of the side wall of the sample container adjoining thereon in the direction towards the base of the sample container. Hence, an additional material accumulation for the formation of the coupling element is dispensed with. In addition to this, the joining effort is also reduced, as a previous mutual orientation is only required and to be carried out in axial orientation.

Moreover, a first side face of the first groove, said first side face facing the open end of the sample container, forms an abutment surface for an end face of the extender element in the region of its first open end. Hence, secure mutual support in the axial direction between the sample container and the extender element is created. This is particularly significant for the support of the extender element in the course of carrying out a centrifugal operation.

Furthermore, several support elements arranged distributed across the circumference are provided, said support elements being arranged on the outer surface of the second container wall section of the container wall and projecting beyond the outer surface towards the side facing away from the longitudinal axis. By providing support elements, hence, a better positional fixing in the joined position is created between the sample container and the extender element. Thus, bending and unintended releasing of the extender element from the sample container when the coupling elements are coupled are prevented.

It is also provided for that the support elements are formed as webs, said webs having a particularly parallel longitudinal extent with respect to the longitudinal axis. Thereby, an even better guiding and axial stabilization of the sample container and the extender element with respect to one another are achieved.

Moreover, an outer envelope of the support elements, in particular of the webs, has a diameter, said diameter being equal to or slightly larger than an inner diameter of the side wall of the extender element in the region of its open end. Hence, a sufficient support effect and an additional mutual axial stabilization in the joined position are achieved. Moreover, thereby, the bending stiffness of the tubular components joined together to form the collection assembly is increased.

Furthermore, in the base wall of the extender element, at least one breakthrough, preferably several breakthroughs, is/are arranged, said breakthrough or said breakthroughs perforating the base wall. Hence, despite the formation of the coupling device, build-up of a pressure difference with respect to ambient pressure (excess, vacuum) within the inside surrounded by the extender element is prevented. Moreover, hence, in the course of a subsequent evacuating operation the collecting chamber is co-evacuated. A possible forced pressing in and associated suction of air present in the inside of the extender element into the collecting chamber of the sample container are also prevented by this.

Hence, the storage period of the collection assembly until its use is extended.

Furthermore, the at least one breakthrough is arranged at a distance from the longitudinal axis in the radial direction and the base wall is formed continuously in the region of the longitudinal axis. Hence, a stable support surface, which is formed continuously and without interruptions, is created in the center region of the base wall. Moreover, a central injection point can be selected and maintained for the manufacturing process.

It can further be advantageous if, as viewed in axial section, the outer surface and the inner surface of the first container wall section each directly transition into the outer surface and into the inner surface of the second container wall section forming a bend. This allows for a sufficiently high filling level to be achieved in the base region of the sample container even with a small filling quantity. Hence, the filling volume can be easily controlled and, additionally, the collection of the sample also in case of a low sample amount can be facilitated. Hence, the residual volume (dead volume) of the sample in the base region of the sample container can also be kept very low.

Another embodiment is characterized in that the at least one second coupling element is formed by a wall section of the side wall of the extender element as well as by at least one second recess arranged to be recessed in an inner surface of the side wall. By providing a separate recess in the side wall of the extender element, the additional material accumulation for the formation of the second coupling element can also be dispensed with here.

A further preferred embodiment is characterized in that the at least one second coupling element is formed by a wall section of the side wall of the extender element as well as by a continuous peripheral second groove in the inner surface of the side wall. This allows the joining operation to be carried out simply with a preceding mutual axial alignment.

It can further be advantageous if, when the first and the second coupling elements are in coupled engagement, the wall section of the side wall of the extender element engages in the first groove and that a second side face of the first groove closer to the base of the sample container and a wall section of the container wall of the sample container adjoining thereon in the direction towards the base of the sample container engage in the second groove. Hence, the coupling device with the cooperating coupling elements can be formed with the lowest possible material input and merely by arranging and forming recesses or grooves as well as merely by wall sections of the side wall as well as wall sections of the container wall. Thus, additional connecting means, such as a weld connection, a bonding connection or another materially bonded connection, in the coupling region can be dispensed with.

In a further embodiment, it is provided for that a closure device by means of which the open end of the sample container is closed is provided. Hence, a sterile collecting chamber can be provided already prior to filling of the collecting chamber until use.

Lastly, a further preferred embodiment is characterized in that the collecting chamber closed by the closure device is reduced to a pressure reduced as compared to ambient pressure. Hence, filling and suction of the sample into the collecting chamber can be facilitated and the filling volume of the sample amount can be predetermined more precisely.

For the purpose of better understanding of the invention, it will be elucidated in more detail by means of the figures below.

Figure 2:
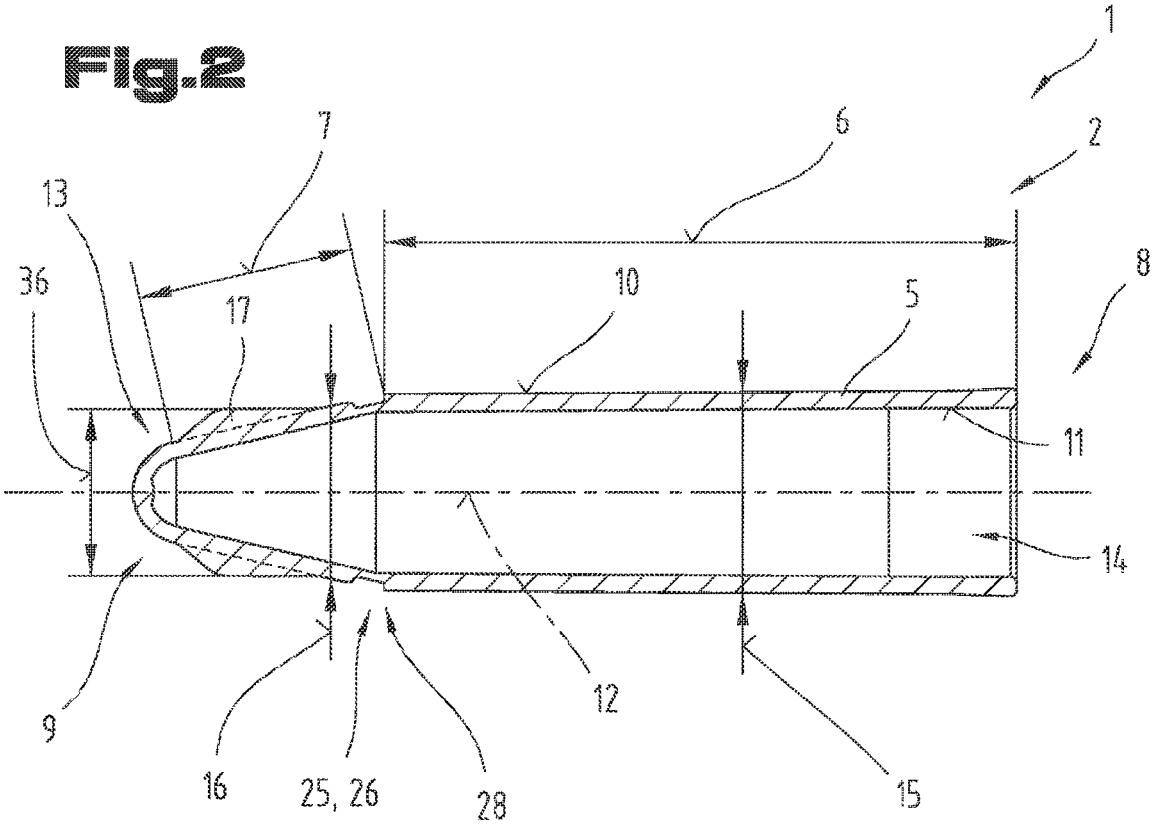
Figure 3:
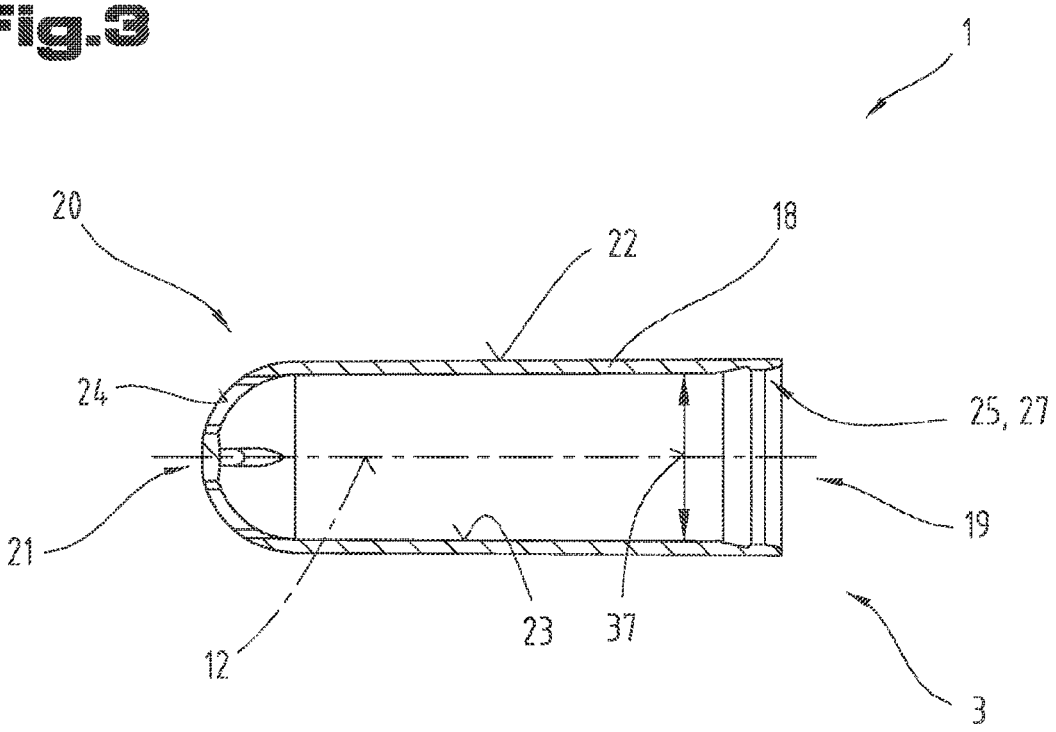
Figure 4:
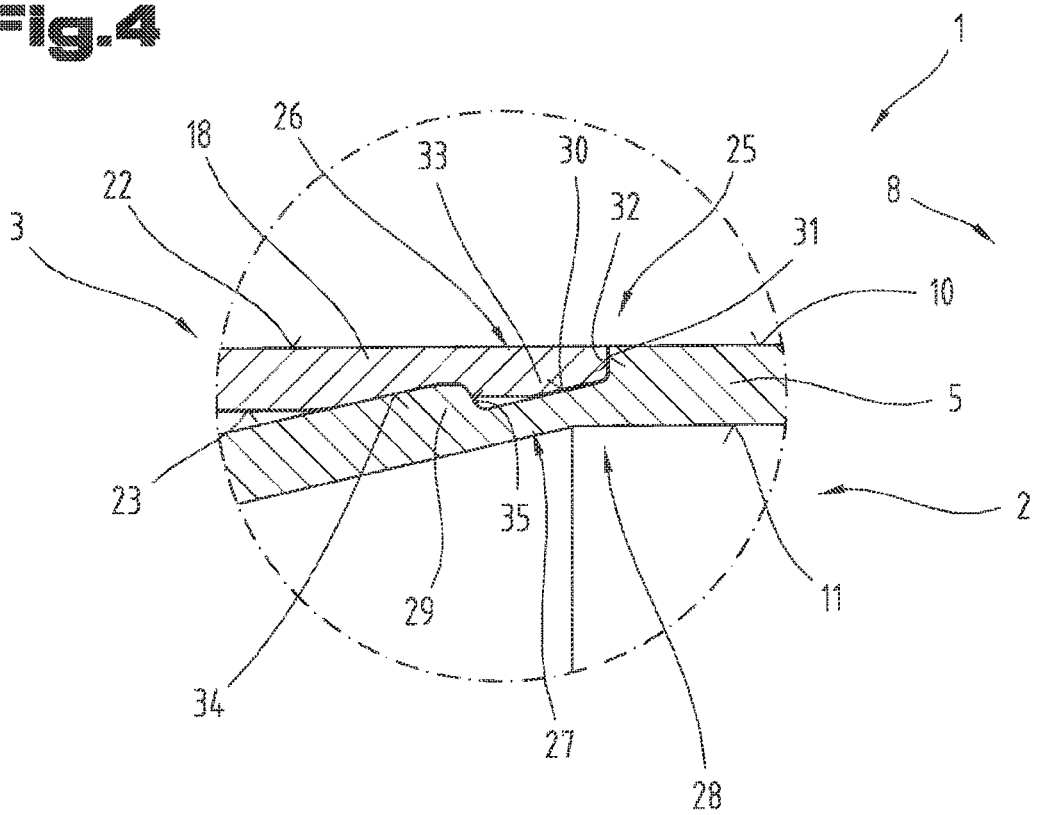
Figure 5:
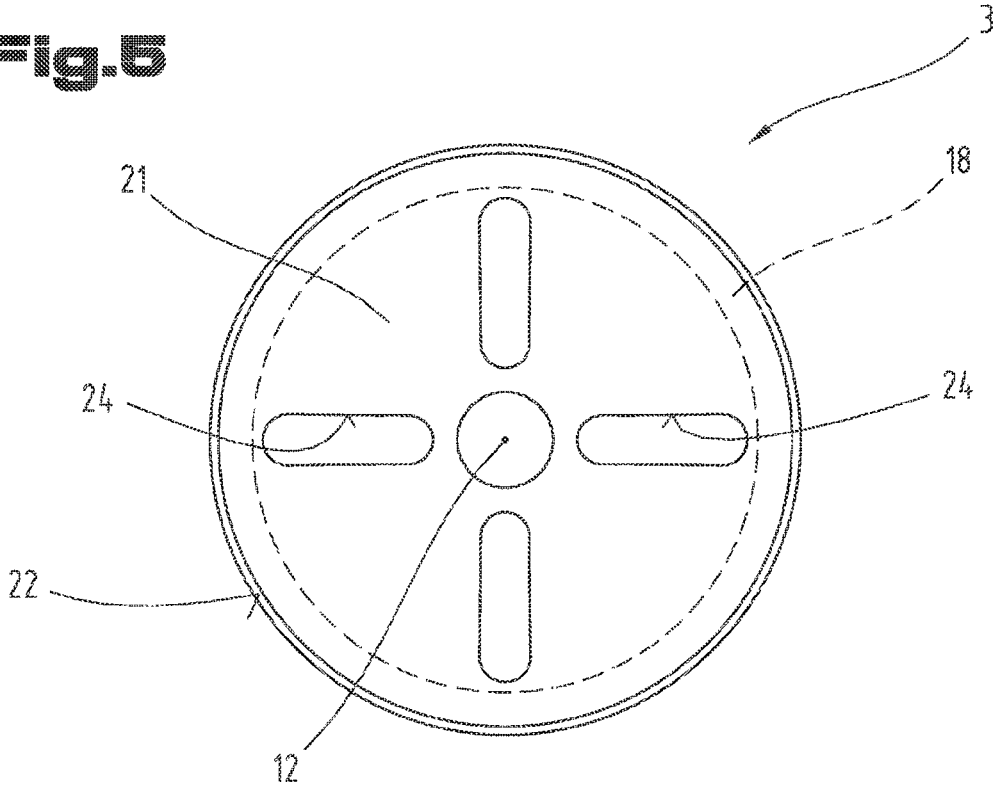

These show in a respectively very simplified schematic representation:

FIG. 1 a collection assembly with a sample container, an extender element as well as a closure device still arranged at a distance therefrom, in a diagrammatic representation, partially in a sectional view;

FIG. 2 the sample container according to FIG. 1 in axial section;

FIG. 3 the extender element according to FIG. 1 in axial section;

FIG. 4 the coupling device between the sample container and the extender element with the coupling elements being in coupled engagement, in axial section and enlarged representation;

FIG. 5 a view onto the base wall of the extender element.

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

The term "particularly/in particular" is hereinafter understood such that it may refer to a possible, more specific embodiment and more detailed specification of a subject matter or a method step, but does not necessarily have to represent an obligatory, preferred embodiment of the latter or an obligatory approach.

FIGS. 1 to 5 show a collection assembly 1 of several components, which serves for gathering and collecting small amounts of body fluids, in particular blood samples, urine, *salvia* or the like. Usually, so-called sample collection tubes are used for such purposes; these can also be referred to as blood drawing tubes or blood collection tubes. Although these collection tubes are most commonly referred to as blood drawing tubes or blood collection tubes, other body fluids mentioned above or other biological fluid samples can also be gathered and collected therein.

To allow for an automated sample analysis and/or a centrifugal operation to be carried out after filling of the sample tubes, such sample tubes have predefined and standardized dimensions. For example, the outer nominal diameter as well as the nominal axial length are understood as standard dimensions. In this regard, there are tubes with a nominal diameter of 13 mm or 16 mm. The nominal axial length can for example amount to 75 mm or 100 mm. For example, 13/75 can be indicated as the short designation for a closed tube with a nominal diameter of 13 mm and an axial length of 75 mm. It is also possible that dimensions are used which have nominal diameters or nominal axial lengths deviating form the aforementioned dimensional indications.

As in this collection assembly 1 a receiving volume smaller than that of the aforementioned collection tubes is provided for collection, the receiving chamber should also have a smaller receiving volume than the standard tubes. The different constructions are suggested to reduce the receiving volume with approximate retention of the outer standard dimensions. For this purpose, there are embodiments as a one-piece solution or also as a multi-part or multi-piece solution.

The collection assembly 1 is preferably used for the collection of blood, in particular of venous blood, which is collected merely in small collection amounts and is kept in the respective collection assembly 1 for subsequent examinations. However, other biological fluid samples can also be gathered in the collecting chamber. The collecting chamber 14 can also be referred to as receiving chamber, which has a receiving volume that is smaller than that of the collecting tubes with standardized dimensions.

For example, the collecting chamber 14 of the sample container 2 can have a receiving volume with a lower limit of 1 ml and an upper limit of 3 ml, in particular between 1.5 ml and 2.5 ml (milliliters). Hence, the collecting chamber 14 has a receiving volume that is reduced as compared to that of the collection containers with standard dimensions that were described above. A sample tube with the standard dimension 13/75 can for example have a maximum receiving volume of 4.5 ml. An attempt has also been made to include only 1 ml of sample amount in those sample tubes with the 13/75 standard dimension and the 4.5 ml receiving volume. Due to the high volume difference between the maximum possible receiving volume of 4.5 ml and the low filling amount of 1 ml, in sample tubes with a pressure present in the receiving chamber that is lower than the ambient pressure, the extent of pressure difference is very sensitive. The preset low pressure difference for determining the suction volume of 1 ml can change within certain limits in case of changing ambient conditions, such as temperature and air pressure, and result in a deviating suction volume in case of a reduction. Due to the reduced maximum receiving volume of the receiving chamber or collection assembly in this collection assembly 1, the pressure difference can in turn be increased with respect to the ambient pressure in the evacuated state.

Moreover, due to the progress of technology, an ever smaller sample amount is required for the determination of clinical parameters. The sample amount can also be referred to as sample volume. Previous collection or sample tubes for small sample volumes, however, had smaller dimensions, especially length dimensions, than the standardized dimensions. However, so as to allow for this collection assembly 1 to be inserted into and received in the centrifuge devices or laboratory machines that are also standardized, the embodiments described below are improved such that a use in standardized centrifuges, laboratory machines, analysis devices or the like is possible despite the low receiving volume.

The collection assembly 1 comprises at least one sample container 2 and an extender element 3 that can be joined together therewith. FIG. 1 shows the joined and assembled state of both components, wherein, however, a closure device 4 is shown in a position raised with respect thereto. In FIGS. 2 and 3, the respective components, meaning the sample container 2 and the extender element 3, are shown individually.

The sample container 2 comprises a container wall 5 with a first container wall section 6 and a second container wall section 7 arranged adjoining thereto. The container wall 5 extends between a first open end 8 and a second end 9 arranged at a distance therefrom and is limited by an outer surface 10 and an inner surface 11. Furthermore, the container wall 5 defines a longitudinal axis 12. The same designation of the longitudinal axis is selected also for the extender element 3, as the common longitudinal axis 12 is formed in the assembled, joined state of the sample container 2 with the extender element 3 and both longitudinal axes 12 are arranged congruently to one another.

In the region of the second end 9, a base 13 is provided, which is connected to the container wall 5 in one piece and forms a tight closure. The container wall 5 and the base 13 together delimit a collecting chamber 14.

Preferably, both the sample container 2 and the extender element 3 are each separately produced from a plastic material in an injection molding operation. In this regard, the material can be formed predominantly translucent to glass-clear and be selected from the group of PP (polypropylene), PS (polystyrene), PET (polyethylene terephthalate), PE (polyethylene), PA (polyamide), PC (polycarbonate).

To demold the components from the injection mold, a small mold chamfer is usually provided in order to facilitate the demolding process. Hence, the container wall 5 starting out from the region of the open end 8 in the direction onto the second end 9 has a low conicity. Generally, both the sample container 2 and the extender element 3 have a circular ring cross-section and are thus formed tubularly.

In this embodiment of the sample container 2, it is provided for that the first container wall section 6 is formed generally hollow-cylindrically and has a first diametric dimension 15. The diametric dimension 15 can be formed so as to decrease to a slight extent starting out from the first open end 8 in the direction towards the base 13 due to the demolding chamfer described above. However, it would also be possible that a constant diametric dimension 15 is provided.

Here, the second container wall section 7 of the container wall 5 is formed hollow-conically and at least sectionally has a second diametric dimension 16 smaller as compared thereto. The term "sectionally" is used since, as viewed in axial section, the outer surface 10 of the first container wall section 6 transitions into the outer surface 10 of the second container wall section 7 merely by forming a bend or an angular offset and has the same diameter in this transition region. However, the inner surface 11 of the first container wall section 6 also transitions into the inner surface 11 of the second container wall section 7 by forming a further inside bend or a further angular offset. Hence, due to the hollow cone shape, a sufficient filling level in the collecting chamber 14 can be achieved also for a low filling quantity, which is sufficient for the proper determination of the filling volume and the subsequent sample collection. Moreover, hence, the manufacturing operation, in particular the injection point in the baseside end 9 of the base 13 can also be selected in its center.

Additionally, at least one support element 17, however, preferably several support elements 17, can be provided, which are arranged on the outer surface 10 of the second container wall section 7 of the container wall 5 and project beyond the outer surface 10 towards the side facing away from the longitudinal axis 12. If several support elements 17 are provided, this can be arranged to be distributed, in particular uniformly distributed, across the circumference. In order to achieve a good support effect for the extender element 3 on these, at least three to four of them are to be arranged or provided.

The support element(s) 17 can be formed as webs and have an approximate to full parallel longitudinal extent with respect to the longitudinal axis. In this regard, the longitudinal extent refers to the longitudinal extent of the webs which can also be provided with a common mold chamfer so as to facilitate demolding from the injection molding tool. Furthermore, a radial arrangement can be provided for. The support elements 17 serve the axial alignment and mutual stabilization of the sample container 2 and the extender element 3 in the joined state. Additionally, these can also be used for mutual support and connection if a dimensional coordination with respect to one another has been carried out. The mutual support and connection is to be provided by means of a coupling device 25, which will be described in further detail below. The coupling device 25 could also be referred to as coupler device.

It also would be conceivable that the sample container 2 is formed hollow-conically in its second container wall section 7 of the container wall 5 and that no coupling device 25 is provided. In this case, the mutual support and connection of the sample container 2 and the extender element 3 could be established by a fixed connection of at least one of the support elements 17 to the extender element 3. This could be carried out by means of a bonding operation or a welding operation. This will be elucidated in further detail below.

The extender element 3, in turn, comprises a side wall 18, which extends between a first open end 19 and a second end 20. A base wall 21 is arranged or provided so as to adjoin the second end 20. The side wall 18 is limited by an outer surface 22 and an inner surface 23 and also has a preferably circular-ring-shaped cross section. The base wall 21 of the extender element 3 can be formed calotte-shaped, in particular hollow-spherical-calotte shaped.

At least one breakthrough 24, which perforates or penetrates the base wall 21 entirely, can be formed in the base wall 21 of the extender element 3. This can be seen from the combination of FIGS. 1, 3 and 5. However, preferably several, in the present exemplar embodiment four, breakthroughs 24 can be provided. The breakthrough(s) 24 are further arranged at a distance from the longitudinal axis 12 in the radial direction. Hence, the base wall 21 remains continuous and closed in a central region or a central section around the longitudinal axis 12. Thus, a good and unhindered force introduction, as occurs during the support during a centrifuging process, can be achieved in this surface section of the base wall 21. Moreover, hence, a central injection point for the production can be selected as well. The stability of the base wall 21 can thus be maintained in an almost unaltered manner despite the arrangement and formation of the breakthroughs 24. The breakthrough(s) 24 also serve the purpose of allowing access to the inside of the extender element 3 also when the sample container 2 and the extender element 3 are joined to one structural unit. This particularly applies when the first open end 19 of the extender element 3 is in coupled engagement with the sample container 2 by means of the coupling device 25 and an air-tight connection is formed by the coupling device 25.

The coupling connection can be formed so as to be predominantly air-tight. By means of the breakthroughs 24, an undesired inclusion of air in the inside of the extender element 3 can be prevented. If the inside is entirely tightly sealed, this can lead to an increase in internal pressure as the temperature rises and can in further consequence result in an undesired separation of the sample container 2 and the extender element 3. Moreover, air still present in the evacuated collecting chamber 14 can be pressed out of or be sucked out of the inside of the extender element 3 into the collecting chamber 14.

The extender element 3 serves for being joined to an assembly unit, namely the collection assembly 1, together with the sample container 2. Hence, by the separate formation of the sample container 2 and the extender element 3, the manufacturing operation can be optimized for each of the components and the common standard dimension of length and diameter can be achieved with a good support effect and stability despite the small receiving quantity or the small receiving volume. The separate production can also have the advantage that the structural lengths of each component, sample container 2 and extender element 3, can be varied with respect to one another and coordinated with one another more easily. If a shorter sample container 2 is needed, the extender element 3 is to be elongated by the applied shortening length of the sample container 2.

To connect the sample container 2 with the extender element 3 to form an assembled unit and also to hold it firmly and securely thereon, the separate coupling device 25, which comprises at least one first coupling element 26 and at least one second coupling element 27 that can be coupled thereto, is provided here. Here, the at least one first coupling element 26 is arranged or formed on the sample container 2 and the at least one second coupling element 27 is arranged or formed on the extender element 3. When the coupling elements 26, 27 are in coupled engagement with one another, the collection assembly 1 is established in its tube form. The coupled engagement is established between the two interlocking coupling elements 26 and 27 on a positively locked basis. However, these can also be referred to as coupler elements. Preferably, the coupled engagement is established such that a separation of the two components from one another can only be carried out with considerable effort. Hence, an unintended separation of the two components from one another can be prevented. The coupling device can be designed in the form of a snap connection.

In the coupled state, the sample container 2 at least partially projects into the first open 19 of the extender element 3 with its second container wall section 7 distanced from the open end 8 in the direction of the longitudinal axis 12.

The at least one first coupling element 26 is arranged or formed in a transition section 28 between the first container wall section 6 and the second container wall section 7. The transition section 28 is located in the region of the bend described above between the outer surfaces 10 of the container wall 5 extending angled with respect to one another. Preferably, the at least one first coupling element 26 is arranged in the second container wall section 7 with a predominant portion, in particular surface portion, and also can extend into the first container wall section 6 to a slight extent.

It would also be possible to move the first coupling element 26 of the coupling device 25 farther in the direction of the first open end 8 and to thus arrange it within the first container wall section 6. In order to create a planar transition between the outer surface 22 of the extender element 3 and the outer surface 10 of the sample container 2, the wall thickness are to be coordinated as regards their dimensions.

The at least one first coupling element 26 can for example be formed by at least one first recess arranged in the outer surface 10 of the container wall 5 as well as by a wall section 29 of the container wall 5 of the sample container 2 adjoining thereon in the direction towards the base 13 of the sample container 2. Instead of the recess or the recesses, however, a first groove 30, which is formed continuously as seen across the circumference of the sample container 2, can also be provided. The wall section 29 forms a part of the first coupling element 26 here as well. In order to form an axial abutment for the extender element 3, in particular for an end face 31 of the side wall 18 in the region of the open end 19, a first side face 32 of the first recess or the first groove 30 is provided. The side face 32 of the first recess or the first groove 30 forms an abutment surface.

As can further be gathered from the representation in FIG. 3, the side wall 18 of the extender element 3 between the first open end 19 and the second end 21 is formed hollow-cylindrically. As was already described before, here, the side wall 18 can also be formed with or provided with a slight demolding chamfer in the region of the outer surface 22 and/or in the region of the inner surface 23. This is also covered by the designation "hollow-cylindrical". Except for the provision and formation of the second coupling element 27, the side wall is continuous and straight as seen in axial section between the first open end 19 and the second end 21.

Here, the at least one second coupling element 27 is formed by a wall section 33 of the side wall 18 of the extender element 3 in the direct region of the first open end 19 as well as by at least one second recess arranged to be recessed in the inner surface 23 of the side wall 18. Instead of the recess or the recesses, however, a second groove 34, which is formed continuously as seen across the circumference of the sample container 2 and recessed in the inner surface 23, can also be provided. The wall section 33 of the side wall 18 of the extender element 3 forms a part of the second coupling element 27 here as well.

When the coupling elements 26 and 27 are in coupled engagement with one another, the wall section 33 of the side wall 18 of the extender element 3 engages in the first recess or in the first groove 30 of the sample container 2. Moreover, a second side face 35 of the first recess or the first groove 30 closer to the base 13 of the sample container 2 as well as the wall section 29 of the container wall 5 of the sample container 2 adjoining thereto in the direction towards the base 13 of the sample container 2 engage in the second recess or in the second groove 34 of the extender element 3. The wall section 29 is formed directly by a partial section of the hollow-conically formed second container wall section 7 of the container wall 5.

As was already briefly described, the support elements 17 can be arranged or formed on the second container wall section 7 of the container wall 5. By the selection of the hollow-conical formation of the second container wall section 7, a sufficient support of the extender element 3 on the sample container 2 can be achieved. Thus, for guiding and stabilization of position in the coupling position, in particular also for transverse forces to be absorbed, the support elements 17 are to be provided. It is also provided for in this regard that an outer envelope of the support elements 17, in particular of the webs, has a diameter, said diameter 36 being equal to or slightly larger than an inner diameter 37 of the side wall 18 of the extender element 3 in the region of its open end 19. In case of a slight excess in the region of their outer envelope of the support elements 17 formed as webs, additionally to the coupling connection, a force fit by means of a press fit and a corresponding flush resting and support of the inner surface 23 of the extender element 3 on the support elements 17, in particular the webs, can be achieved in the joined state. Hence, a further mutual stabilization of the sample container 2 and the extender element 3 can be created in addition to the coupling connection.

In addition to this, it would also be possible to form a bonding connection and/or a welding connection in at least one mutual support region of a support element 17, in particular one of the webs, and the inner surface 23 of the extender element 3. This can for example be carried out on a materially bonded basis. The welding operation can for example be carried out by means of ultrasonic welding or the like.

However, it would also be possible to form the outer envelope of the support elements 17, in particular of the webs, with a diameter which is slightly smaller than the inner diameter 37 of the side wall 18 of the extender element 3 in the region of its open end 19. However, this does not provide such good mutual stabilization and axial alignment. In case of a bending stress in the coupling region, this could result in an undesired separation of the sample container 2 and the extender element 3.

Hence, it becomes possible to form the outer envelope of the support elements 17, in particular of the webs, with a diameter which is slightly smaller than or equal to or even slightly larger than the inner diameter 37 of the side wall 18 of the extender element 3 in the region of its open end 19.

The closure device 4 shown in FIG. 1, in a known manner serves for closing off the first open end 8 of the sample container 2 and thus also the collecting chamber 14 with respect to the outer surrounding. The closure is to be formed so as to be at least liquid-tight, in particular also gas-tight, as has been carried out in known manner with standard tubes to date. Additionally, the collecting chamber 14 can also be reduced to a pressure reduced with respect to the ambient pressure. Hence, due to the receiving volume lower as compared to that of the standardized collection tubes, the pressure in the collecting chamber 14 in this sample container 2 can also be further reduced in order to be able to better predefine the suction volume, this, however, not being obligatorily required.

There can be cases of application in which the collecting chamber 14 is closed by means of the closure device 4, however, the entire closure device 4 is to be removed from the open end 8 of the sample container 2 for inserting the sample and filling in of the corresponding sample can be carried out only afterwards. It would also be possible that the inner surface 11 as well as optionally also the base 13 with its base surface facing the collecting chamber 14 is provided with a coating for treatment of the filled-in sample.

The closure device 4 is shown in FIG. 1. In this regard, reference is made to the different embodiments as are, among others, described in EP 0 419 490 B1, in EP 0 445 707 B1 or in EP 1 711 412 B1. In order to avoid unnecessary repetitions, reference is made to these patents and their family members with respect to the embodiment possibilities of the closure device 4.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the teaching for technical action provided by the present invention lies within the ability of the person skilled in the art in this technical field.

The scope of protection is determined by the claims. However, the description and the drawings are to be adduced for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

| List of reference numbers | |
|---|---|
| 1 | collection assembly |
| 2 | sample container |
| 3 | extender element |
| 4 | closure device |
| 5 | container wall |
| 6 | first container wall section |
| 7 | second container wall section |
| 8 | first open end |
| 9 | second end |
| 10 | outer surface |
| 11 | inner surface |
| 12 | longitudinal axis |
| 13 | base |
| 14 | collecting chamber |
| 15 | first diametric dimension |
| 16 | second diametric dimension |
| 17 | support element |
| 18 | lateral wall |
| 19 | first open end |
| 20 | second end |
| 21 | base wall |
| 22 | outer surface |
| 23 | inner surface |
| 24 | breakthrough |
| 25 | coupling device |
| 26 | first coupling element |
| 27 | second coupling element |
| 28 | transition section |
| 29 | wall section |
| 30 | first groove |
| 31 | end face |
| 32 | first side face |
| 33 | wall section |
| 34 | second groove |
| 35 | second side face |
| 36 | diameter |
| 37 | inner diameter |

The invention claimed is:

1. A collection assembly for collecting a small amount of a body fluid, comprising:

a sample container with a container wall, said container wall extending from a first open end to a second end, being limited by an outer surface and an inner surface and defining a longitudinal axis, and with a base, said base closing the second end of the container wall and surrounding a collecting chamber together with the container wall; and wherein the container wall comprises a first container wall section and a second container wall section adjacent thereto in the direction of the longitudinal axis; wherein the first container wall section is formed hollow-cylindrically with a first outer diametric dimension and is arranged starting out from the open end; and wherein the second container wall section comprises an at least sectionally smaller second diametric dimension with respect to the first outer diametric dimension of the first container wall section; and wherein a transition section is arranged between the first container wall section and the second container wall section; and further comprising:

an extender element having a side wall, said side wall extending from a first open end to a second end, and having a base wall arranged to be adjacent to the second end, wherein the base wall of the extender element is calotte-shaped; and wherein the sample container at least partially projects into the first open end of the extender element with its second container wall section arranged at a distance from the first open end in the direction of the longitudinal axis; and further comprising:

a coupling device with at least one first coupling element and with at least one second coupling element; wherein the at least one first coupling element is arranged or formed on the sample container and the at least one second coupling element is arranged or formed on the extender element; and wherein when the first and second coupling elements are in coupled engagement, the extender element is coupled to the sample container in a positively locked manner by means of a snap connection formed by the coupling elements establishing the collection assembly;

wherein the second container wall section of the container wall of the sample container is formed hollow-conically;

wherein the at least one first coupling element is arranged in the transition section between the first container wall section and the second container wall section of the container wall;

wherein the side wall of the extender element between the first open end and the second end is formed hollow-cylindrically; and wherein the side wall is formed to be continuous and straight as seen in axial section between the first open end and the second end;

wherein the at least one first coupling element is formed as a continuous peripheral first groove as well as the wall section of the side wall of the sample container adjoining thereon in the direction towards the base of the sample container;

wherein a first side face of the first groove, said first side face facing the open end of the sample container, forms an abutment surface for an end face of the extender element in the region of its first open end and the first side face forms an axial abutment for the first end face of the extender element;

wherein several support elements arranged distributed across the circumference are provided, said support elements being arranged on the outer surface of the second container wall section of the container wall and projecting beyond the outer surface towards the side facing away from the longitudinal axis;

wherein the support elements are formed as webs, said webs having a particularly parallel longitudinal extent with respect to the longitudinal axis;

wherein an outer envelope of the webs forming the support elements has a diameter, said diameter being equal to or slightly larger than an inner diameter of the side wall of the extender element in the region of its open end;

wherein in the base wall of the extender element, at least one breakthrough is arranged, said at least one breakthrough perforating the base wall; and wherein the at least one breakthrough is arranged at a distance from the longitudinal axis in the radial direction and the base wall is formed continuously in the region of the longitudinal axis.

2. The collection assembly according to claim 1, wherein, as viewed in axial section, the outer surface and the inner surface of the first container wall section each directly transition into the outer surface and into the inner surface of the second container wall section forming a bend.

3. The collection assembly according to claim 1, wherein the at least one first coupling element is with a predominant portion arranged in the second container wall section.

4. The collection assembly according to claim 1, wherein the at least one second coupling element is formed by a wall section of the side wall of the extender element as well as by a continuous peripheral second groove in the inner surface of the side wall.

5. The collection assembly according to claim 4, wherein when the first and the second coupling elements are in coupled engagement, the wall section of the side wall of the extender element engages in the first groove and wherein a second side face of the first groove closer to the base of the sample container and a wall section of the container wall of the sample container adjoining thereon in the direction towards the base of the sample container engage in the second groove.

6. The collection assembly according to claim 1, wherein a closure device is provided by means of which closure device the first open end of the sample container is closed.

7. The collection assembly according to claim 6, wherein the collecting chamber closed by the closure device is reduced to a lower pressure than ambient pressure.

* * * * *